US011834943B2

(12) United States Patent
Zagre et al.

(10) Patent No.: US 11,834,943 B2
(45) Date of Patent: Dec. 5, 2023

(54) SYSTEMS, APPARATUSES, AND METHODS FOR DETERMINING ROCK-COAL TRANSITION WITH A DRILLING MACHINE

(71) Applicant: Peck Tech Consulting Ltd., Montreal (CA)

(72) Inventors: Gilles Eric Palobde Zagre, Montreal (CA); Viktor Shlenchak, Longueuil (CA); Jonathan Phillip Peck, Magog (CA)

(73) Assignee: Peck Tech Consulting Ltd., Montreal (CA)

( * ) Notice: Subject to any disclaimer, the term of this patent is extended or adjusted under 35 U.S.C. 154(b) by 589 days.

(21) Appl. No.: 17/097,201

(22) Filed: Nov. 13, 2020

(65) Prior Publication Data

US 2021/0148214 A1 May 20, 2021

Related U.S. Application Data

(60) Provisional application No. 62/936,205, filed on Nov. 15, 2019.

(51) Int. Cl.
*E21B 44/02* (2006.01)
*E21B 49/00* (2006.01)

(52) U.S. Cl.
CPC ..... *E21B 44/02* (2013.01); *E21B 49/003* (2013.01)

(58) Field of Classification Search
CPC ..... E21B 44/02; E21B 49/003
See application file for complete search history.

(56) References Cited

U.S. PATENT DOCUMENTS

2014/0278113 A1 9/2014 Chok

FOREIGN PATENT DOCUMENTS

| | | | | | |
|---|---|---|---|---|---|
| CN | 1361347 | | | 7/2002 | |
| CN | 103174423 | | | 3/2015 | |
| CN | 104215649 | B | | 2/2017 | |
| CN | 107631997 | A | * | 1/2018 | |
| CN | 109989740 | A | * | 7/2019 | ..... G06F 16/29 |
| CN | 110259442 | | | 9/2019 | |
| CN | 111160668 | A | * | 5/2020 | ..... G06F 16/29 |

* cited by examiner

*Primary Examiner* — Mark A Connolly

(57) ABSTRACT

A system, apparatus, and method for controlling operation of a drilling machine includes determining a rock-coal transition and enabling both the real-time control of the blasthole drilling operation of the drilling machine responsive to the determination of the rock-coal transition or using the rock-coal transition information for mine planning in a post-processing application. Such controlling can include stopping the drilling operation of the drilling machine prior to or upon reaching the coal. Mine planning allows for more efficient removal of the exploitable coal. The determining and controlling can be performed in real time based on specialized transformation of Monitor-While Drilling (MWD) data from one or more sensors of the drilling machine while the drilling machine is drilling. The mine planning application is based on processing the Monitor-While Drilling (MWD) data from one or more sensors of the drilling machine after the drilling machine has completed the drilling of a blasthole or blastholes.

20 Claims, 5 Drawing Sheets

SYSTEMS, APPARATUSES, AND METHODS FOR DETERMINING ROCK-COAL TRANSITION WITH A DRILLING MACHINE

CROSS-REFERENCE TO RELATED APPLICATION(S)

This application claims the benefit under 35 U.S.C. § 119(e) of Provisional App. No. 62/936,205, filed Nov. 15, 2019, wherein the entire content and disclosure of which is hereby incorporated by reference herein in its entirety.

TECHNICAL FIELD

The present disclosure relates to detection of rock-coal transition to identify coal seams, and particularly using a drilling machine equipped with sensors to collect blasthole drilling performance data and machine learning to detect the rock-coal transition. The detected rock-coal transition may be used for mine blast design, mine planning, and control of the drilling component of a blasthole drilling machine.

BACKGROUND

Towards being able to extract coal in a commercially viable way in an open pit mine, it can be desirable or even necessary to have detailed information on the presence and characteristics of the inherent geology (i.e. including coal seams that are bound by other waste rock units) at the site. Specifically, the design and execution of a viable blast design that involves the placement of explosives, can require three-dimensional, geospatial information (depth, thickness, X-Y location) regarding the presence of viable (e.g., commercially viable) coal seams. Based on such information, explosives can be placed in waste rock zones versus at the location of an exploitable coal seam, where if blasting did occur within or near to the exploitable coal seam (e.g., in the exploitable coal seam), the value (e.g., commercial value) may be undesirably diminished due to the loss of this material.

Obtaining such detailed coal seam information, generally, can be problematic, for instance, because the process may be performed manually, which may tend to be relatively subjective since derived either from an operator's ability to sense (e.g., audible and visual indicators) or from geophysical logging methods that need to be inserted into the blasthole post-drilling (which can also require additional cost and/or time, as well as being subject to depth error (i.e., due to misalignment)). In addition, the interpretation of geophysical logs to identify coal seams can be inaccurate, time consuming and influenced by the skills and experience of the technician that conducted the survey.

Chinese Patent Document CN 104215649 ("the CN '649 Patent Document") describes an automatic coal and rock identification device and method of a coal mining machine. According to the CN '649 Patent Document, the method comprises the steps of human-computer interaction, data acquisition, data filtering calculation, identification of a coal and rock interface and data transmission. The CN '649 Patent Document also describes that the automatic coal and rock identification device integrates the predictable identification and the real-time identification by utilizing multiple identification means, so that the predictable identification and the real-time identification are mutually complemented and corroborated, and the accuracy and the efficiency of identification are improved.

SUMMARY OF THE DISCLOSURE

In one aspect, a coal detection system for detecting transitions between coal and other types of rock and identifying location of coal seams when a drilling machine is performing a drilling operation is disclosed. The system can comprise a high sampling frequency data acquisition sub-system comprising hardware and firmware configured to continuously collect drill performance data from sensors of the drilling machine; and a data analytics sub-system comprising a computing platform configured to continuously pre-process the acquired drill performance data including one or more of signal aggregation, outlier removal, signal coefficient of variation, and transformations, wherein the real-time data analytics sub-system is configured to apply a plurality of machine learning algorithms to the pre-processed blasthole drill performance data, dynamically amalgamate results from the plurality of machine learning models into a hybrid model to determine a probability value as an indication of a transition between coal and other types of rock that the drill machine is drilling through coal, and the determined probability value indicating the rock-coal transition.

In another aspect, a method is disclosed. The method can comprise acquiring data from one or more sensors of a drilling machine; determining, using processing circuitry, based on the acquired data, whether the drilling machine is operating in a drilling mode or a non-drilling mode; responsive to the drilling machine being determined to be operating in the drilling mode, transforming, using the processing circuitry, the acquired data into predefined standardized units as the drilling machine operates in the drilling mode; applying, using the processing circuitry, the transformed data to normalization and calibration techniques to ensure consistent results regardless of the variability and noise inherent to Monitor While Drilling data; applying, using the processing circuitry, the transformed data to a plurality of pre-trained machine learning models as the drilling machine operates in the drilling mode to generate a corresponding plurality of coal probability values; generating, using the processing circuitry, a single coal probability value prediction by processing the plurality of coal probability values using a stacked neural network; applying, using the processing circuitry, cleansing and segmentation processing to detect continuity in adjacent downhole segments identifying an upcoming or immediate rock-coal transition; determining, using the processing circuitry, whether the single prediction regarding the rock-coal transition identifies the upcoming or immediate rock-coal transition; and outputting, using the processing circuitry, a control signal to stop drilling of the drilling machine responsive to the determined identification of the upcoming or immediate rock-coal transition.

And in another aspect, a non-transitory computer-readable storage medium storing computer-readable instructions that, when executed by one or more computers, cause the one or more computers to perform a method is disclosed. The method can comprise acquiring data from one or more sensors of a drilling machine; determining based on the acquired data, whether the drilling machine is operating in a drilling mode or a non-drilling mode; responsive to the drilling machine being determined to be operating in the drilling mode, transforming the acquired data into predefined standardized units as the drilling machine operates in the drilling mode; applying the transformed data to a plurality of pre-trained machine learning models as the drilling machine operates in the drilling mode to generate a corresponding plurality of coal probability values; generating a single coal probability value prediction by processing the plurality of coal probability values using a stacked neural network; applying cleansing and segmentation processing to detect continuity in adjacent downhole segments identifying an upcoming or immediate rock-coal transition; and outputting one or more signals to stop drilling of the drilling machine responsive to the generated single prediction identifying the upcoming or immediate rock-coal transition.

Other features and aspects of this disclosure will be apparent from the following description and the accompanying drawings.

DETAILED DESCRIPTION

Embodiments of the disclosed subject matter involve controlling blasthole drills, and more particularly to systems, apparatuses, and methods for determining rock-coal transition in order to control blasthole drills.

Figure 1:
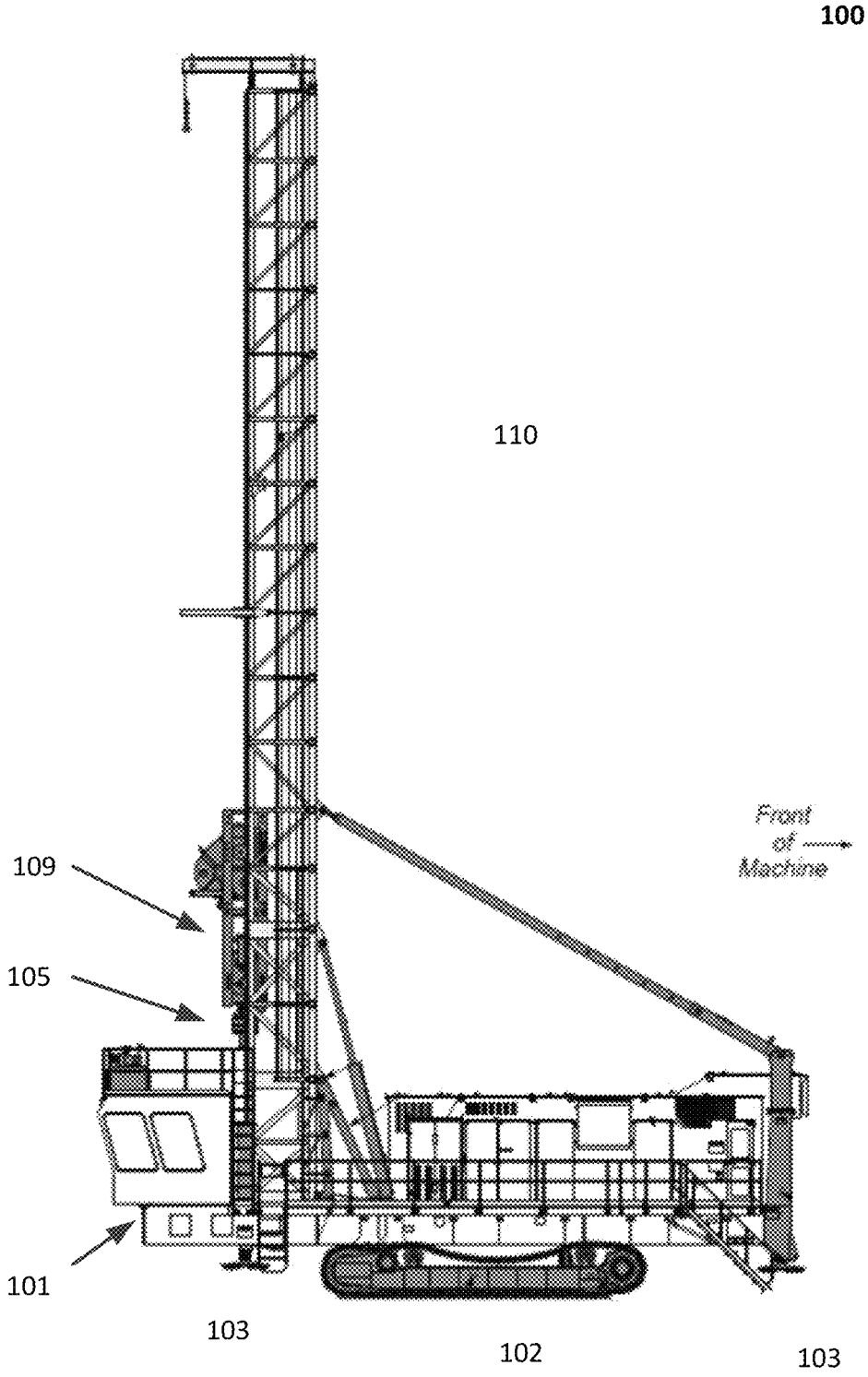
FIG. 1 shows a side view of a drilling machine according to one or more embodiments of the disclosed subject matter.
Figure 2:
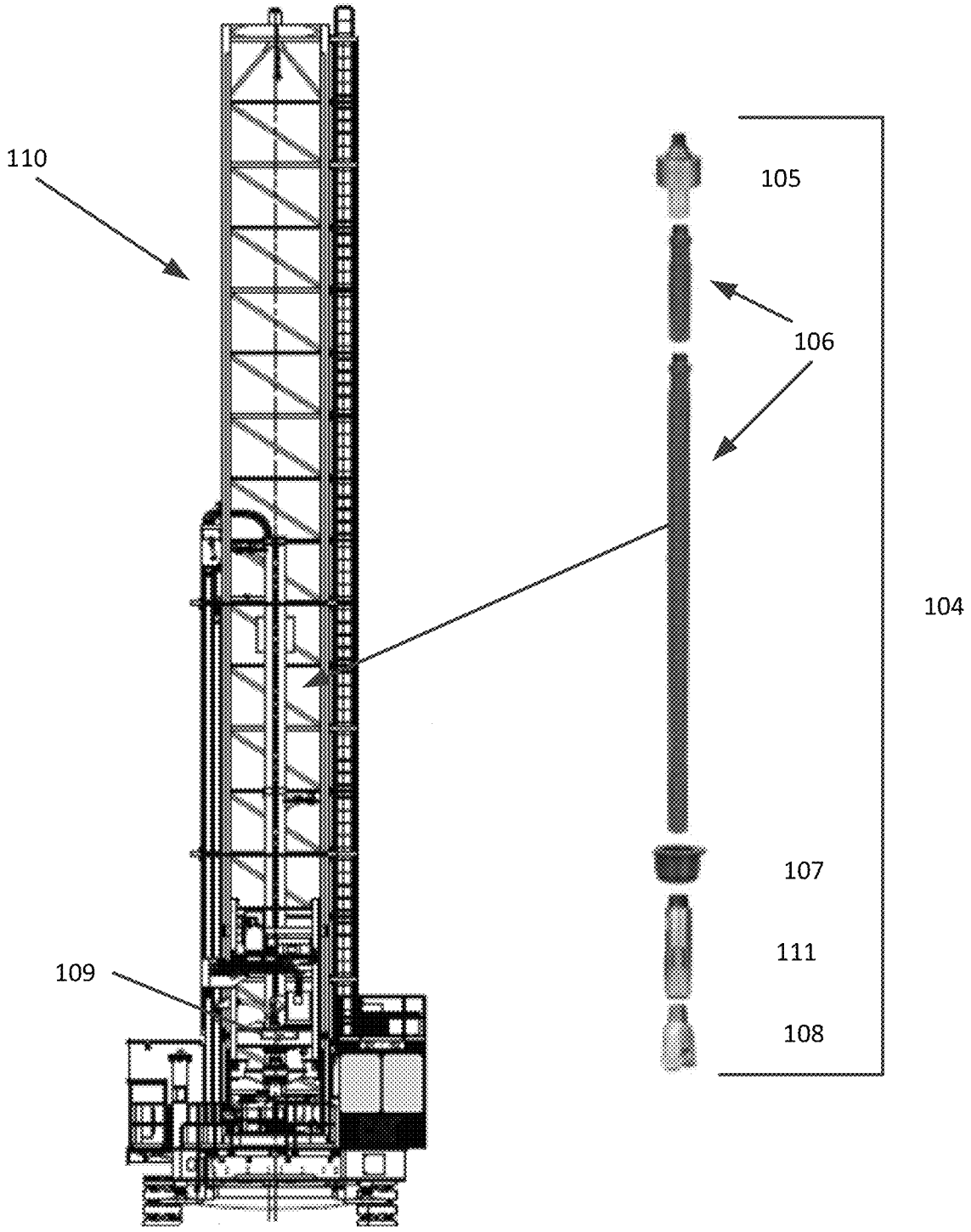
FIG. 2 shows an exploded view of a drilling machine according to one or more embodiments of the disclosed subject matter.

FIG. 1 and FIG. 2 show representations of a drilling machine 100 according to embodiments of the disclosed subject matter. Generally, the drilling machine 100 can be used to drill a hole into intact rock using a rotary tricone drill bit. The hole may be referred to as a borehole or a blasthole, and may be filled with explosive and non-explosive materials (e.g., explosives) for the purpose of fragmenting and breaking the intact rock material in the vicinity around the hole. The positioning of the explosives in the blasthole may be selective in nature, for instance, to liberate and gain access to select rock material(s), such as coal, without undesirably damaging such select rock material and also to achieve the required blast outcome (e.g. rock fragmentation, blast movements and muckpile diggability).

The drilling machine 100 can be comprised of a main frame 101 provided on a crawler assembly 102, such as a set of tracks, to move the drilling machine 100. The drilling machine 100 can also have a set of leveling jacks 103 that can be individually adjusted to level (e.g. make horizontal) the main frame 101 prior to the start of drilling to create a substantially vertical blasthole.

The drilling machine 100 can have a mast assembly 110 operatively coupled to the main frame 101, which can be used to support (including raise and lower) a drill string assembly 104, which may be comprised of multiple drill string components 106. A rotary drill bit 108 can be provided at a bottom end of the drill string assembly 104, and a rotary gearcase 109 can be provided at a top end of the drill string assembly 104. The drill string assembly 104 rotates through a deck bushing 107 to align and guide the drill steel 106 and a shock coupling 105 may be added to the drill string assembly 104 to absorb axial and transverse vibrations generated by the rotation of the drill string assembly 104 and rock breakage mechanisms at the interface between the intact rock and the rotary drill bit 108.

Generally, the rotary gearcase 109 can apply pulldown pressure and rotate the drill string assembly 104 based on operation of one or more electric motors operatively coupled to or as part of the rotary gearcase 109 and mast assembly 110. Hence, according to embodiments of the disclosed subject matter the drilling machine 100 can be characterized as an electric drilling machine 100. Hence, the drilling machine 100 can control the drill steel 106 to rotate so as to progressively break the intact rock material using the rotary drill bit 108 attached to the end of the drill string assembly 104 while under an applied axial (vertical) load.

Figure 3:
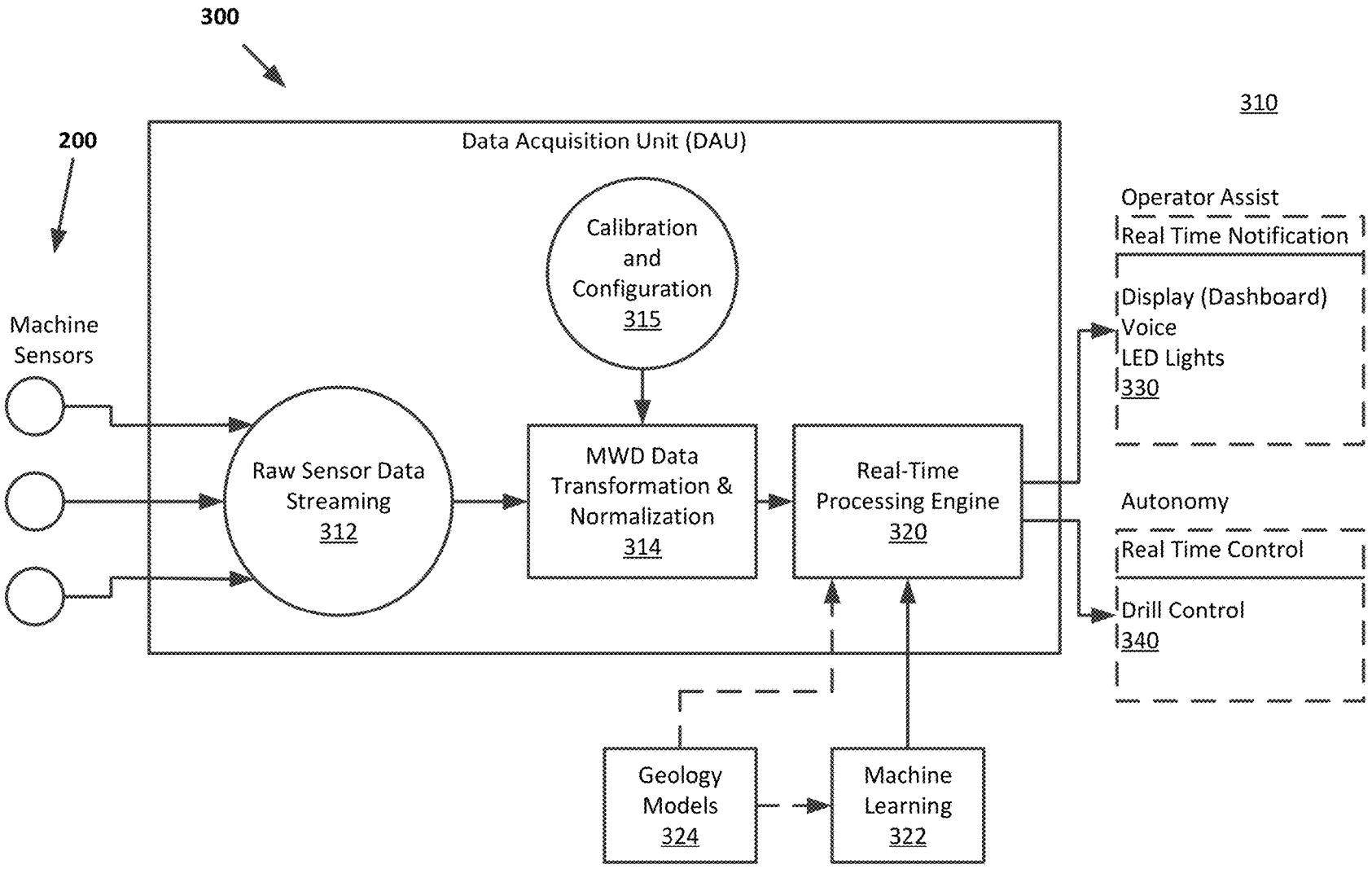
FIG. 3 is a block diagram of a system according to one or more embodiments of the disclosed subject matter.
Figure 4:
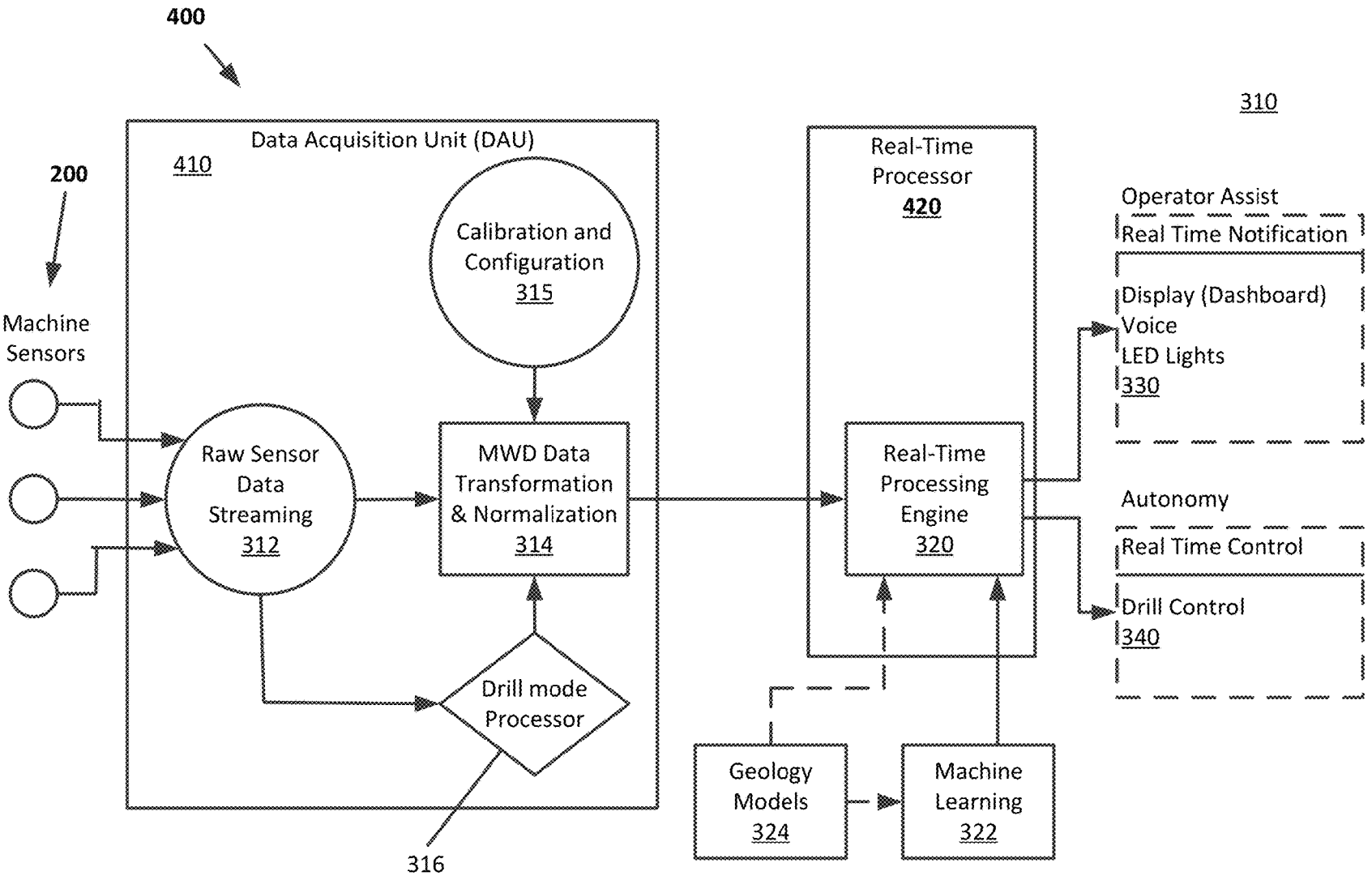
FIG. 4 is a block diagram of a system according to one or more embodiments of the disclosed subject matter.

Turning to FIG. 3 and FIG. 4, these figures show a system 300 and a system 400 for detecting rock-coal transitions and controlling the drilling operation of the drilling machine 100 based on (e.g., responsive to) the detection of the rock-coal transition. Generally, system 300 and system 400 may differ in terms of where some or all of the real-time processing is performed. Of course, embodiments of the disclosed subject matter are not limited solely to the delineations set forth in FIG. 3 and FIG. 4 regarding acquisition and processing arrangements.

System 300, which can be implemented in drilling machine 100, can be comprised of a processing module 310. Such processing module 310 may, according to one or more embodiments, be referred to as a Data Acquisition Unit (DAU). The processing module 310 may be implemented using a processor or processing circuitry, implemented in hardware, software, or a combination of the two.

The data acquisition unit 310 may be deployed external to the drilling machine 100. In such an arrangement, high sampling frequency data acquisition sub-system on the drill machine acquires, records and transmits to the external data acquisition unit 310 blasthole drill performance data. The external data acquisition unit 310 may be implemented in a server application that detects new input data and dynamically collects and bundles context information as well as selects and applies correct configuration. The processing in the server is automated and does not require human operator intervention. The data analytics sub-system can be configured to dynamically amalgamate results from the multiple machine learning algorithms into a hybrid model to determine a probability value that the drilling machine drilled through coal, and output the determined probability values indicating a rock-coal transition to a third party blast design or mine planning software application.

System 300 also can include or otherwise interface with one or more sensors 200 of the drilling machine 100. Such one or more sensors 200 can include sensor(s) 200 adapted to sense or measure operating characteristics or parameters of the drilling machine 100 during a drilling operation of the drilling machine 100. For instance, such sensor(s) 200 can sense the vertical displacement (e.g. in inches or centimeters, feet or meters) of the drill string assembly 104 for conversion into depth of the rotary drill bit 108 in the blasthole (e.g. feet or meters) and depth of cut (DOC), rotary speed (e.g., in rpms based on monitoring electric motor voltage), rate of penetration (ROP in feet per hour), torque (TRQ in ft-lbs based on monitoring electric motor current), weight on bit (WOB in lbf), pulldown pressure (hoist pull down force in lbf), and/or specific energy of drilling (SED) as the rotary drill bit 108 descends through the intact rock material. Some or all of the signals from the sensor(s) 200 may be characterized as Monitor-While-Drilling (MWD) signals. Regarding the foregoing, the outputs from the sensor(s) 200 to the processing module 310 can be analog, digital, or a combination of the two. Vibration sensors 200 may be added to sense or measure vibrations in the drilling machine 100 as a way to potentially enhance the robustness of the system 300.

The system 300 can acquire or sample the data from the sensor(s) 200 at a relatively high rate, for instance, 200 Hz (i.e., every 0.005 second), as the rotary drill bit 108 rotates and descends into the rock material, via interface 312. According to one or more embodiments, the sampling frequency can be configurable/reconfigurable according to the particular application. Such sampling frequency may be high enough to prevent or minimize data aliasing. Additionally, according to one or more embodiments, the acquiring frequency may be greater than a frequency or frequencies associated with rock type (i.e., coal or not coal) identification processing and drilling adjustments (e.g., stopping the drill string assembly 104 and rotary drill bit 108). In disclosed embodiments, the sampling frequency may be in a range of 10 Hz to 400 Hz. In some embodiments, the sampling frequency may be as low as 40 to 50 Hz, but is preferably about 200 Hz. Optionally, interface 312 can include memory. Hence, the data from the sensor(s) 200 can be stored in the memory, at least temporarily, for retrieval and processing.

The system 300, via interface 312, can thus repeatedly acquire drill machine 100 performance measurements from the sensor(s) 200 for specific drill parameters of the drilling machine 100 at respective current depths of the rotary drill bit 108 as the rotary drill bit 108 descends into the rock material. In that the data from the sensor(s) 200 can be sampled at a relatively high frequency (or frequencies), the data can be provided as raw data with sufficiently high granularity.

The processing module 310 can also determine or detect when the drilling machine 100 is in a drilling mode or a non-drilling mode (i.e., drilling or not drilling). Such determination can be based on the drilling environment or context. In this regard, the processing module 310 can selectively process data, for instance, only process the data from the sensor(s) 200 when the drilling machine 100 is in the drilling mode. For instance, the processing module 310 can begin processing (e.g., recording) the data from the sensor(s) 200 when the processing module 310 determines that drilling has commenced and stop processing (e.g., recording) when the processing module 310 determines that the drilling has stopped. Upon the stopping of the drilling (e.g., because an exploitable coal seam has been identified), the data may be saved in one or more files, either locally on the processing module 310 or offboard the processing module 310. Optionally, the data processing for determining rock-coal transition may begin after a predetermined parameter has been achieved after the drilling has commenced, for instance, after reaching a certain depth in the blasthole.

According to one or more embodiments, the density of the earthen material may be computed in order to assess the system 300. A rock mass value may be determined post-drilling based on using a downhole geophysical probe that is inserted into the open blasthole. This rock mass value may be used to compute the density of the earthen material. The density measurement from a geophysical probe is used as the yardstick to assess the ability to predict density based on using the monitored drilling variables. In some embodiments, the density may be computed during the drilling, and may be recorded at about every 0.01 meters to 0.02 meters.

The interface 312 can output the sampled signals from the sensor(s) 200 to a Monitor-While-Drilling (MWD) module 314. Generally, the MWD module 314 can perform preprocessing and convert each of the raw signals from the sensor(s) 200, i.e., the parameter measurements, to specific advantageous engineering units or values, according to desired conversion aspects. Such engineering units or values may be characterized as "standard" and/or "real" engineering values or units, that can represent meaningful information for further processing to identify rock-coal transitions. For instance, the engineering units may reflect parameters at the rotary drill bit 108 interface (e.g., pulldown pressure or force at the interface) with intact rock rather than more broadly defined parameters (e.g., overall pulldown pressure or force of the drill string assembly 104). Optionally, some or all of the converted engineering units may be standardized gaussian values. Regarding the foregoing discussion of MWD data, it is noted that reliable rock type classification is more likely to be achieved when the MWD data used are reliable measurements of the real parameters.

The MWD module 314, according to one or more embodiments, can apply signal correction (e.g., smoothing by weighted average) on each parameter measurement to obtain a more reliable measurement of the parameter at the current depth in order to convert to the specific desired engineering unit. As an example, in order to take advantage of the relatively high granularity of the MWD data, each MWD signal can be smoothed, via the MWD module 314, for instance, using a triangular moving average with a sliding window of elements. The size of the sliding window may be dynamically adjusted. For example, for a transient signal the sliding window may be adjusted to a smaller size than when the signal is for a steady signal. Also, the number of elements is relative to the amount of data in the depth window. For example, 201 elements may be sufficient to cover data in a 0.02 m depth window. The weights can be normalized, and the window can be centered at the middle point (the highest weight is attributed to the middle point). In this regard, for instance, let $X_i$ represent the entry i (ranked by increased depth) of a given MWD signal (e.g., Torque, WoB . . . ), and $X_i^{av}$ is the averaged signal corresponding to that entry i, then the associated weights:

$$X_i^{av} = \sum_{k=i-100}^{i+100} w_k X_k,$$

$$\text{where } \sum_{k=i-100}^{i+100} w_k = 1 \text{ and } w_k = \frac{4}{(n-1)^2}\left[\frac{n-1}{2} - \left|\frac{n+1}{2} - k\right|\right].$$

This aggregation can result in a smoothing of the signal that can help in reducing signal variability and mitigate potential outliers values.

Optionally, the processing module 310 can include a calibration and/or configuration module 315. Such calibration/configuration module 315 can be used to configure and/or calibrate the processing of the MWD module 314 according to the particular application and/or type of drilling machine 100. For instance, calibration/configuration module 315 can set or define the specific signals for which the MWD module 314 is to process and transform, can define parameters or constraints for the specific signals based on a consumable (e.g., rotary drill bit 108 force limitations, diameter), static weight of the rotary gearcase 109 and drill string assembly 104, the type of rock material, and/or preference (e.g., of an operator) for operation of the drilling machine 100.

The processing module 310 can include a real-time processing module 320 that can receive the output(s) of the MWD module 314. As noted above, reliable rock type classification is more likely to be achieved when the MWD data used are reliable measurements of the real parameters, as provided by the MWD module 314. The real-time processing module 320 can process the transformed MWD data from the MWD module 314 using one or more different machine learning models provided by machine learning module 322. That is, the transformed MWD data can be used as input features in the one or more machine learning models. According to one or more embodiments, each of the one or more different machine learning models can be used to predict whether the drill bit 108, for example a rotary tricone drill bit, has reached or is about to reach an exploitable coal seam (i.e., top of coal). For instance, each of one or more machine learning models can provide a respective prediction of the probability of the rotary drill bit 108 being at or about a coal seam.

The machine learning model(s) may be trained in the machine learning module 322 using a supervised learning algorithm or an unsupervised learning algorithm, In supervised learning algorithms, the machine learning model is trained with pairs of known input and output. Machine learning model(s) that can be trained using supervised learning include some or all of one or more of the following algorithms: linear regression, logistic regression, extreme gradient boosting, decision tree, k-nearest neighbor, support vector machine (SVM), and/or artificial neural networks. In unsupervised learning algorithms, the machine learning model performs learning based only on input. For example, unsupervised learning algorithms may cluster together similar inputs. The resulting clusters may be used as a trained machine learning model. Machine learning model(s) that can be trained using unsupervised learning include K-means and self-organizing map neural networks.

In some embodiments, to create the pre-trained machine learning model(s), signals based on the raw MWD signals can be used as input features in the machine learning models, for instance, one or more transformations of the original MWD variables. Amongst these input features are the coefficients of variation of the MWD signals which represents a measure of the signal variability. The inventors have determined that some of the operation parameters of the drilling machine may fluctuate differently when drilling in soft rock than in hard rock. To capture that characteristic, the signal coefficient of variation (CV) also known as relative standard deviation which is the ratio of the standard deviation over the mean, is included as an input feature:

$$\mathrm{X_CV}_i = \frac{\sqrt{\sum_{k=i-100}^{i+100} (X_k - X_i^{avg})^2}}{X_i^{avg}}$$

In the above equation, the standard deviation can be calculated using the set of raw MWD data in the corresponding averaging window.

In addition to the coefficient of variation, one or more transformations of all MWD signals (square value, inverse, square root) can be included as input features. The inventors have determined that such specific signal transformations may be more correlated to the coal or rock density than the original signal.

As an example, according to one or more embodiments, a subset (e.g., selected or reduced set) of variables used for input features to train the machine learning models can be rotation rate (rpms), torque, rate of penetration (ROP) coefficient of variation, weight on bit (WOB), and the inverse of specific energy of drilling (SED). Optionally, the same subset of variables may be used for the real-time processing of the real-time processing module 320.

Optionally, one or more geology logs models from geology module 324 may be provided to the machine learning module 322 and/or the real-time processing module 320. As an example, the geology log modules can be based on geophysical logging data having reference depth (m) and/or reference density (g/cm3) measured at every 0.02 m, for instance.

According to one or more embodiments, combinations of the different machine learning models can be combined using ensemble learning, such that model predictions from the machine learning models may be evaluated to obtain a single prediction. The actual combination type and weights of the different models can be dependent on the combination of the measurements values, such as those chosen above. There are several different approaches to ensemble learning. One approach is to use majority voting. Another approach to ensemble learning is known as stacking. According to one or more embodiments of the disclosed subject matter, the real-time processing module 320 can implement stacking by including an artificial neural network to identify (e.g., predict) a single rock-coal transition by being fed predictions from the machine learning models. Such identification may be based on tracking of density values, for instance, in real-time (which also may be based on an artificial neural network). In this regard, such prediction, based on the different probabilities, may characterize a transition from rock to coal, either before actually reaching the coal or upon reaching the coal.

The real-time processing module 320 may implement stacked artificial neural networks to determine the rock-coal transition. In this regard, such determination may be based on processing to predict rock density during the drilling process, which may be used to classify the rock material as "coal" or "not coal." In this regard, the real-time processing module 320 can anticipate or predict an upcoming coal seam, for instance, because the rock density can be determined and predicted to be decreasing. Optionally, this can be used with a priori knowledge of how many coal layers there may be. Thus, embodiments of the disclosed subject matter can identify rock-coal transition using rock density and a coal probability curve, for instance. For instance, a decrease in the two signals with knowledge that coal is likely to be in this area can be used to predict an upcoming coal layer. Provided such a prediction that coal is likely to be in this area, a drilling machine 100 may stop drilling, according to embodiments of the disclosed subject matter, before reaching the coal layer.

Further refinements may be necessary to prediction of coal-rock boundary transitions. MWD is time domain data. Using the depth measure, defined by depth from the collar, the results are reported on a regular downhole interval basis. For example, data resolution for DAU may be 0.01 m. The machine learning models compute coal probabilities and the integrated model computes a single coal probability value for each of these intervals. It has been determined that the computed probabilities may still be subject to some noise and outliers. This is because areas of boundary transitions typically are the ones which are most affected by noise due to highly variable geological conditions.

In one or more embodiments, data cleansing and segmentation is may be performed to detect continuity in adjacent downhole segments in order to agglomerate segments into more meaningful segment lengths representing the features required for detection of rock-coal boundary transitions.

In order to remove coal stringers or spurious coal prediction, particularly at transition locations, a cleansing and segmentation method may be applied to the final coal probability prediction in order to obtain clearly defined coal seams. The cleansing and segmentation method consists of two methods, which can be individually or jointly applied.

The first method consists in smoothing the coal probability curve using a signal smoothing method. This method is applied when the coal probability curve is considered too noisy. The preferred smoothing method is a simplified implementation of double exponential smoothing an iterative exponential smoothing, described as follows:

Let $P_{coal}^{t}(d)$ be the predicted coal probability at location (depth) d at iteration t; Similarly, $P_{coal}^{t}(d-1)$ and $P_{coal}^{t}(d+1)$ are respectively the coal probability prediction at the preceding location (depth) d−1, and the subsequent location (depth) d+1; then the coal probability at location d and iteration t+1 is:

$$P_{coal}^{t+1}(d) = \alpha P_{coal}^{t}(d) + (1-\alpha)\left[\frac{P_{coal}^{t}(d-1) + P_{coal}^{t}(d+1)}{2}\right],$$

where a is a smoothing factor.

The method can be recursively performed for a predefined number of iterations, or until a defined convergence parameter, such as the average rate of probability change between consecutive iterations, has reached a certain threshold. The initial set of coal probabilities at iteration t=0 is the input coal prediction curve (input curve).

The second method consists of a simple rolling window discarding coal seams below a certain predefined width. The second method may be applied when several predicted coal seams are too thin.

As an example, the integrated coal probabilities are reported for each regular interval (at 1 cm resolution). If a threshold of 50% probability is applied it will result in a binary 'Coal': 'No-Coal' classification, which is also reported by same intervals. In this example, a depth=10.05 m is 'Coal' and depth=14.57 m is 'No-Coal'. At this moment all the intervals are strictly regular and each would have an assigned value. What is seen as binary initial segments at this stage is the regular depth deltas between two reporting intervals. In this example, an interval at depth=10.05 m equals to segment that is defined by Depth 10.045 m to 10.055 m. so for this specific hole of depth 18.50 m there are 1850 initial regular segments.

In predicting rock-coal transitions (for commercially viable coal seams) there may be some issues. There may be a stringer just below 2 m of depth, where a few intervals were classified as coal. And there may be some noise at the bottom of the coal seam which makes that transition undefined within at least 0.5 m. The cleansing and segmentation allow detection of continuity in adjacent downhole segments and agglomeration into more meaningful segment lengths. In the example, 3 agglomerated [irregular] segments may be obtained for the entire hole:

Segment 1: Depth 0.00 m to 9.11 m is 'No-Coal'

Segment 2: Depth 9.12 m to 12.48 m is 'Coal'

Segment 3: Depth 12.49 m to 18.50 m is 'No-Coal'.

The drilling machine 100 performs a drilling operation and sensors 200 sense or measure operating characteristics or parameters of the drilling machine during the drilling operation. The sensors 200 may sense unwanted change regarding the behavior of the drilling machine 100, possibly caused by gradual deterioration, noise, and even abrupt failures. In one or more embodiments, an evaluation module may be used to monitor the prediction error of the real-time processing module 320 for a certain period. If the error increases over the certain period, the evaluation model may determine that the drilling machine 100 may be encountering signal drift. In the one or more embodiments, the real-time processing module 320 may undergo re-training when signal drift is detected and the increase in prediction error is greater than a predetermined threshold.

The real-time processing module 320 may use the single prediction to control operation of the drilling machine 100. That is, the real-time processing module 320 can send a signal to stop drilling of the drilling machine 100 when the single prediction indicates a transition from rock to coal.

For instance, according to one or more embodiments, the real-time processing module 320 can send one or more signals representative of identification of the transition to an operator interface 330 (though FIG. 3 shows the operator interface 330 in the processing module 310 the operator interface 330 can be provided outside of the processing module 310). Examples of operator interface 330 can be a dashboard or display in a control area (e.g., cabin of the drilling machine 100) for the drilling machine 100, a speaker in the control area, and/or one or more visual indicators, such as one or more lights. The operator interface 330 may also be provided in a remote location from the drilling machine 100. For example, the operator interface 330 can be a display of a mobile device in the field or a desktop computer display in a back office. The human operator at the remote location may be in a line of sight or a non-line of sight view to the drilling machine 100. The one or more signals can cause the operator interface 330 to signify to the operator that a transition to a coal seam has been detected. As noted above, such transition can mean an upcoming transition or the rotary drill bit 108 initially reaching the coal seam. In response to the operation of the operator interface 300 indicating the transition, the operator can control the drilling machine 100 to stop drilling, for instance, before reaching the coal seam or upon reaching the coal seam. Such stopping can include, at the least, removal of pulldown forces and/or stopping revolution of the drill string assembly 104 and rotary drill bit 108.

Additionally or alternatively, the real-time processing module 320 can send one or more signals representative of identification of the transition to a drill control system 340 (though FIG. 3 shows the drill control system 340 in the processing module 310 the drill control system 340 can be provided outside of the processing module 310). In response to the signal(s) the drill control system 340 can automatically stop the drilling machine 100. Such stopping can include, at the least, removal of pulldown forces and/or stopping revolution of the drill string assembly 104 and rotary drill bit 108.

Turning to FIG. 4, system 400 can generally operate the same as or similar to system 300. However, as noted above, system 400 can differ from system 300 in terms of where particular parts of the real-time processing occur. Notably, the system 400 can include a data acquisition module 410 and a real-time processing module 420. Thus, in some respects the system 400 may be characterized as the combination of the data acquisition module 410 for use with real-time application using the real-time processing module 420 to identify rock-coal transitions, albeit in the context of two separate modules, particularly wherein the real-time processing of the real-time processing module 420 is not performed by the data acquisition module 410.

The data acquisition module 410 can operate the same or similar to a portion of the processing module 310 of system 300, particularly the interface 312, the calibration and configuration module 315, and the MWD module 314. Differently, however, the data acquisition module 410 can provide the output thereof (i.e., the output of the MWD module 314) to outside the data acquisition module 410, in this case to the real-time processing module 420. The data acquisition module 410 may also include a drill mode feature or module 316 to determine whether the drilling machine 100 is operating in a drilling mode or a non-drilling mode. Based on the output of the drill mode module 316, the MWD module 314 can be controlled to selectively process the data from the sensor(s) 200 (via the interface 312), for instance, only when the drilling machine 100 is drilling. Of course, to be clear, the system 300 may, according to one or more embodiments, implement the drill mode module 316. The remaining processing of the real-time processor 420 can be the same as that discussed above for system 300.

INDUSTRIAL APPLICABILITY

As noted above, embodiments of the present disclosure relate to detection of rock-coal transition to identify coal seams, and particularly using a drilling machine equipped with sensors to collect blasthole performance data and machine learning to detect the rock-coal transition. The detected rock-coal transition may be used for mine blast design, mine planning, and control of the drilling component of a blasthole drilling machine.

More specifically, embodiments of the disclosed subject matter can implement systems and methodologies, for instance, implemented in hardware, software, or a combination or hardware and software, to automatically and precisely identify, in real-time, for instance, the presence of transitions between exploitable coal seams and the surrounding waste materials that are present both vertically and horizontally in an open pit mine. Such identification can be performed with relatively little a-priori information.

The method and system can detect the transition(s) between coal and the surrounding host rock and identify the location of exploitable coal seams using a relatively high frequency data acquisition platform and machine learning models. The system can utilize all available (or a selected subset) performance information acquired from a suite of sensors on the drilling machine 100. For instance, the systems and methodologies can use advanced feature extraction and classification techniques applied to a range of time-series data that are acquired from sensors that monitor the physical performance variables, such as current, voltage, pressure, and displacement of a drilling machine 100, while the drilling machine is performing a drilling operation.

Providing context, time-series data acquired from monitoring the performance of a blasthole drill when plotted to depth exhibit very distinct signal responses in the presence of waste rocks versus coal seams that to the trained eye, can be used for their discrimination. However, to eliminate the signal interpretation subjectivity, methods and techniques can be applied to time-series data to automate such a process.

Approaches can use data acquired from multiple sensors to produce a combined output in the form of a Specific Fracture Energy (SFE) value that through comprehensive field and laboratory studies, has been shown to exhibit a strong correlation to the rock hardness at a specific depth location in a blasthole. An extension of the SFE value is a Compensated Blastability Index ("CBI") value that also enables the accurate identification of the presence of fractures and other discontinuities within an otherwise intact rock mass. The CBI is viewed as being a composite value that may better reflect true, in-situ rock hardness through the incorporation of both identified intact and fractured zones. In the present instance, it is generally seen that coal exhibits a significantly lower rock hardness/CBI value versus harder waste rocks, thus allowing for its ready discrimination by visual or other means.

However, there are many instances when the hardness of some waste rocks and coal seams are very similar making their individual and accurate discrimination difficult. This rock hardness factor can be used with thresholds to categorize each drilled segment into a specific rock category, for example, coal seams versus waste rocks. Blasting engineers use this categorization to design blast patterns to avoid loading explosives at the same depths as areas indicated as coal. Typically, partially processed data need to be transferred back to the office for final processing. This is combined with pre-existing knowledge from core logging activities during the exploration phase of the mine in addition to geological logging of holes from a selection of blastholes from the pattern above.

In addition, it has been determined that the quality of monitored performance data ("Monitoring While Drilling" or "MWD") from a drilling machine, can be a key component of ensuring the best results from the proposed approach. A major uncertainty in the industry that needs to be overcome was the inherent and cumulative noise (versus usable signal) that is present within the acquired time-series data due to electronic acquisition systems as well as the complex breakage mechanisms that are occurring at the bit-rock interface. Additionally, the data may be further complicated by the extensive and unpredictable variability in physical and chemical properties within typical coal bearing geological environments. In the latter case, the transition from overlying waste zones of coaly mudstones and siltstones to exploitable coal seams may be hard to detect accurately using traditional MWD responses due to the similar material strengths.

In addition, traditionally the presence of heavily fractured rock zones may be falsely reported as coal or softer waste materials than what is physically present within the rock mass. And production blasthole drills are often drilling through highly variable geological conditions and along with the effect of progressive bit wear at the bit-rock interface, a complex interplay of noise is introduced into the monitored drill performance data. Additional sources of the variability and noise could be one or many of the following: variability induced by drilling machines and machine sensor calibration errors, operator or auto-drill module performance.

Towards ensuring that the proper real-time data could be acquired and processed to derive accurate coal to waste rock discrimination, an advanced data acquisition platform, such as processing module 310 and data acquiring module 410 according to embodiments of the disclosed subject matter can be implemented. Such processing module 310 and data acquiring module 410 can be specifically designed to acquire data at higher frequencies that are fully configurable according to the application, thus allowing an ability to identify a wider range of geological phenomena. In this regard, the processing module 310 and the data acquiring module 410 can be endowed with suitable computing power and solid-state memory capabilities along with an ability through software configurable hardware components, for instance, to execute some or all of the advanced processing techniques that were developed to recognize coal from time-series data. As indicated above, according to one or more embodiments, the data sampling and rock-coal transition processing can be performed in different modules or components or the same module or component (e.g., but within separate submodules or components). The data acquiring processing of the raw signals from the sensor(s) can be implemented using power supply protection circuitry and/or using sensor input isolation to ensure that the most accurate, least noisy time-series data set can be obtained.

To ensure that sensor data that may be used to train the machine learning models 320 can be obtained from drilling machines having different characteristics and is resilient to upgrades and other changes in a drilling machine such as replacing drill bits due to bit wear, the sensor data may be normalized. In one or more embodiments, the signals from each type of sensor 200 may be scaled to a range, such as 0 to 1, or 1 to 10, etc.

To contend with the highly variable nature of the geology, drilling process and noise inherent to MWD data, embodiments of the disclosed subject matter can utilize advanced data processing and clustering techniques to enable accurate, real-time discrimination of waste rocks and coal seams, particularly when combined with real-condition-representative MWD data captured in suitably granular form (i.e., sufficiently high sampling rate). In this regard, the advanced data processing can include applying normalization and compensation techniques to ensure consistent results regardless of the variability and noise sources mentioned above (e.g modeling and adjusting for the effects of progressive bit wear at the bit-rock interface).

The resulting Coal Recognition ("CR") processing (e.g., algorithm running a non-transitory computer-readable storage medium) can use principal component analysis, Gaussian mixture, k-means, decision trees, and artificial neural network techniques to predict, classify and thus recognize the presence of commercially exploitable coals seams as well as waste rock types and transitional zones (coal to waste rocks, waste rocks to coal), for instance, to within +/−50 centimeters of their actual vertical depth location. That is, the techniques can be amalgamated into a hybrid and dynamic model that produces a final probability value that is a relative indicator used to determine whether the material currently being drilled is "coal," though preferably "not coal," since embodiments of the disclosed subject matter can stop operation of the drill string assembly 104 and rotary drill bit 108 prior to reaching coal or immediately upon reaching coal.

As an example, according to one or more embodiments, once activated, the operation of the system 300 and the system 400 can include:

(1) acquiring repeated machine performance measurements from sensors for specific drill parameters at the current depth. The recorded measurement frequency is always higher than the desired frequency for rock type (coal or not coal) identification;

(2) detecting when in drilling (versus non-drilling) mode based on context provided from the DAU;

(3) applying signal correction (smoothing by weighted average) on each parameter measurement to get a more reliable measurement of the parameter at the current depth and convert the different measurements into standardized gaussian values;

(4) applying additional compensation on one or many parameters measurement to get a normalized measurement of the parameter (e.g adjusting for the effects of progressive bit wear at the bit-rock interface, bit wear or drill configuration).

(5) using the standardized values as attributes in several different pre-trained machine learning models which predict the probability of the drilled rock being coal. Each machine learning algorithm provides a single prediction of the probability of drilling through coal (current drilled rock being coal);

(6) applying linear or nonlinear combinations of the different model predictions into a single prediction. The actual combination type and weights of the different models are dependent on the combination of the measurements values and is at the core of the current approach; and (7) output the probability in real-time for use by a drill operator to manually stop drilling or by a drill control program to automatically stop drilling by the removal of applied pulldown.

Embodiments of the disclosed subject matter can also involve a detection system based on MWD data from monitoring the performance of a blasthole drill that permits the real-time identification of the presence of commercially exploitable coals seams that are bound by waste rock materials on the upper and lower surfaces. The detection system can (1) utilize an integrated high frequency data acquisition and computing platform to collect drill sensor performance data and other contextual process information as the basis for identifying the presence of coal when drilling through coal; (2) utilize a machine learning model for the real-time rock type classification and assigning the probability for the material being coal while drilling; (3) optionally leverage existing knowledge of the geology for the rock mass area being drilled to increase the coal detection accuracy; (4) provides a real-time, coal detection output to the machine operator allowing a visual and/or audible indication of when to manually stop drilling a blasthole; and (5) provides a real-time, coal detection output signal to a control system to automatically stop drilling a blasthole.

Embodiments of the disclosed subject matter can also involve a detection system that can deliver accurate coal picks. The detection system may use dedicated equipment for real-time coal detection and control of a drilling machine, and may also use post-production MWD data in a back-office server for mine blast design and mine planning. In either the real-time coal detection or use of post-production data, the automation level of the process enables coal picks for every blast hole, which is unrealistic to achieve for geophysical logging.

Figure 5:
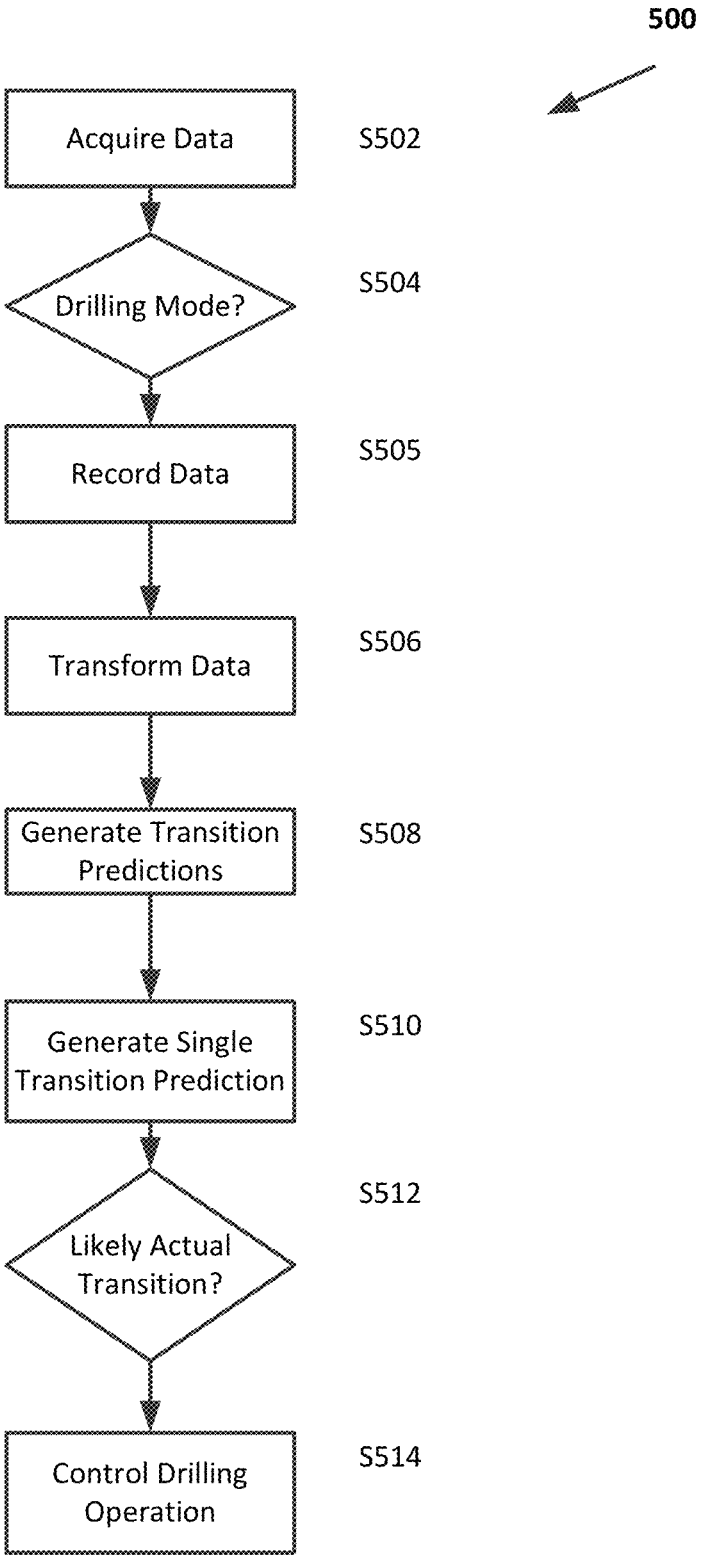
FIG. 5 is a flow chart of a method according to one or more embodiments of the disclosed subject matter.

FIG. 5 is a flow diagram of a method 500 according to embodiments of the disclosed subject matter.

The method 500 can be performed by or under control of the system 300 or the system 400. According to one or more embodiments, the method 500 can be implemented by or according to computer-readable instructions stored on a non-transitory computer-readable storage medium that, when executed by one or more computers, such as processing modules (e.g., circuitry) described herein, perform the method 500.

The method 500, at operation S502, can acquire data from one or more sensors 200, according to a relatively high sampling rate (e.g., at or about 200 Hz), such as described above.

Optionally, such data may be analyzed, for instance, by data acquisition module 410 or processing module 310, for a drill mode module 316, to determine whether the drilling machine 100 is operating in a drilling mode whereby drilling of rock material is taking place, at S504. The method 500 may not proceed until the drilling machine 100 is determined to be in the drilling mode.

At S506 the method 500 can transform the data from the sensor(s) 200 as noted above, for instance according to preprocessing and transformation into a standardized unit providing a realistic nature of the raw data for further processing. The processing at S506 can be performed by MWD module 314, for instance. Moreover, the processing at S506 can be performed when the drilling machine is drilling.

At S508 the method 500 can generate rock-coal transition predictions using corresponding previously-made machine learning models. Optionally, such rock-coal transition predictions one or more geology models, for instance, from geology module 324. The real-time processing module 320 can perform the processing at S508.

At S510 the method 500 can generate a single rock-coal transition prediction based on the previous predictions, for instance, using a machine learning model, such as a neural network, linear regression, non-linear regression, to name a few. Such processing at S510 can be performed by the real-time processing module 320, and can be based on real-time rock density analysis and prediction.

At S512 the method 500 can determine whether the single transition prediction at S510 constitutes a likely actual rock-coal transition. For instance, a probability value associated with the single transition prediction can be compared to a threshold probability and if higher can be indicative of the likely actual rock-coal transition. If the single transition prediction does not indicate the likely actual rock-coal transition, processing can proceed from S512 to S502. On the other hand, if the single transition prediction does indicate the likely actual rock-coal transition, processing can proceed to S514.

At S514 the method 500 can control the drilling operation of the drilling machine 100. Such control can be to stop the drilling operation prior to or upon reaching the coal associated with the rock-coal transition. Such control can be based on one or more control signals sent from the real-time processing module 320, and can be to alert the operator to take manual action to stop the drilling operation prior to or upon reaching the coal or to automatically control the drilling machine 100 to stop the drilling operation without operator intervention.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A coal detection system for detecting transitions between coal and other types of rock and identifying location of coal seams when a drilling machine is performing a drilling operation comprising:

a high sampling frequency data acquisition sub-system comprising hardware and firmware configured to continuously collect drill performance data from sensors of the drilling machine; and a data analytics sub-system comprising a computing platform configured to continuously pre-process the acquired drill performance data including one or more of signal aggregation, outlier removal, signal coefficient of variation, and transformations, wherein the real-time data analytics sub-system is configured to apply a plurality of machine learning algorithms to the pre-processed blasthole drill performance data, dynamically amalgamate results from the plurality of machine learning models into a hybrid model to determine a probability value as an indication of a transition between coal and other types of rock that the drill machine is drilling through coal, and output the determined probability value indicating the rock-coal transition.

2. The coal detection system of claim 1, wherein additional information regarding geological conditions in an area being drilled is leveraged by the real-time data analytics sub-system to refine detection of the transitions between the coal and other types of rock of the system.

3. The coal detection system of claim 1, wherein the output of the determined probability value indicating the rock-coal transition is used to generate a control signal, wherein the control signal causes an operator interface to indicate for the operator to stop the drilling operation to prevent undesirable further drilling relative to the coal.

4. The coal detection system of claim 1, wherein the output of the determined probability value indicating the rock-coal transition is used to generate a control signal, wherein the control signals a drill control system to automatically stop the drilling operation, which prevents undesirable further drilling relative to the coal.

5. The coal detection system of claim 1, further comprising a drill mode sub-system configured to determine when the drilling machine is operating in a drilling mode, wherein a Monitor-While-Drilling sub-system is configured to preprocess and transform the continuously collected drill performance data for processing by the data analytics sub-system only when the drill mode sub-system indicates that the drilling machine is operating in the drilling mode.

6. The coal detection system of claim 5, wherein the drill mode sub-system is part of the high sampling frequency data acquisition sub-system.

7. The coal detection system of claim 1, wherein the output of the determined probability value indicating the rock-coal transition represents a prediction of the location of the coal seam, prior to the drilling operation reaching the coal seam.

8. The coal detection system of claim 1, wherein the high sampling frequency data is acquired at a sampling rate of at or about 200 Hz.

9. A method comprising:

acquiring data from one or more sensors of a drilling machine;

determining, using processing circuitry, based on the acquired data, whether the drilling machine is operating in a drilling mode or a non-drilling mode;

responsive to the drilling machine being determined to be operating in the drilling mode, transforming, using the processing circuitry, the acquired data into predefined standardized units as the drilling machine operates in the drilling mode;

applying, using the processing circuitry, the transformed data to normalization and calibration techniques to ensure consistent results regardless of the variability and noise inherent to Monitor While Drilling data;

applying, using the processing circuitry, the transformed data to a plurality of pre-trained machine learning models as the drilling machine operates in the drilling mode to generate a corresponding plurality of coal probability values;

generating, using the processing circuitry, a single coal probability value prediction by processing the plurality of coal probability values using a stacked neural network;

applying, using the processing circuitry, cleansing and segmentation processing to detect continuity in adjacent downhole segments identifying an upcoming or immediate rock-coal transition;

determining, using the processing circuitry, whether the single prediction regarding the rock-coal transition identifies the upcoming or immediate rock-coal transition; and outputting, using the processing circuitry, a control signal to stop drilling of the drilling machine responsive to the determined identification of the upcoming or immediate rock-coal transition.

10. The method according to claim 9, further comprising controlling the drilling machine to stop drilling responsive to the outputting of the control signal to stop the drilling of the drilling machine.

11. The method according to claim 9, further comprising outputting an indication to an operator, via an operator interface, to indicate to the operator to stop the drilling of the drilling machine via manual control, responsive the control signal to stop drilling.

12. The method according to claim 9, further comprising stopping the drilling of the drilling machine, using a drilling operation controller, responsive to receiving the control signal to stop drilling.

13. The method according to claim 9, wherein the single prediction regarding the rock-coal transition represents a prediction of an upcoming coal seam, prior to the drilling of the drilling machine reaching the coal seam.

14. The method according to claim 9, wherein a sampling frequency of said acquiring data is at or about 200 Hz.

15. A non-transitory computer-readable storage medium storing computer-readable instructions that, when executed by one or more computers, cause the one or more computers to perform a method comprising:

acquiring data from one or more sensors of a drilling machine;

determining based on the acquired data, whether the drilling machine is operating in a drilling mode or a non-drilling mode;

responsive to the drilling machine being determined to be operating in the drilling mode, transforming the acquired data into predefined standardized units as the drilling machine operates in the drilling mode;

applying the transformed data to a plurality of pre-trained machine learning models as the drilling machine operates in the drilling mode to generate a corresponding plurality of coal probability values;

generating a single coal probability value prediction by processing the plurality of coal probability values using a stacked neural network;

applying cleansing and segmentation processing to detect continuity in adjacent downhole segments identifying an upcoming or immediate rock-coal transition; and outputting one or more signals to stop drilling of the drilling machine responsive to the generated single prediction identifying the upcoming or immediate rock-coal transition.

16. The non-transitory computer-readable storage medium according to claim 15, wherein the method further comprises controlling the drilling machine to stop drilling responsive to the outputting of the control signal to stop the drilling of the drilling machine.

17. The non-transitory computer-readable storage medium according to claim 15, wherein the method further comprises outputting an indication to an operator, via an operator interface, to indicate to the operator to stop the drilling of the drilling machine via manual control, responsive the control signal to stop drilling.

18. The non-transitory computer-readable storage medium according to claim 15, wherein the method further comprises stopping the drilling of the drilling machine, using a drilling operation controller, responsive to receiving the control signal to stop drilling.

19. The non-transitory computer-readable storage medium according to claim 15, wherein the single prediction regarding the rock-coal transition represents a prediction of an upcoming coal seam, prior to the drilling of the drilling machine reaching the coal seam, and wherein the upcoming coal seam is a second coal seam in the drilling of a same blasthole, the second coal seam being below a first coal seam passed through when drilling said same blasthole.

20. The non-transitory computer-readable storage medium according to claim 15, wherein a sampling frequency of said acquiring data is at or about 200 Hz.

* * * * *